US008931776B2

(12) United States Patent
Ueyama

(10) Patent No.: US 8,931,776 B2
(45) Date of Patent: Jan. 13, 2015

(54) IMAGE FORMING APPARATUS

(71) Applicant: Junki Ueyama, Nagoya (JP)

(72) Inventor: Junki Ueyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/037,617

(22) Filed: Sep. 26, 2013

(65) Prior Publication Data

US 2014/0091513 A1 Apr. 3, 2014

(30) Foreign Application Priority Data

Sep. 28, 2012 (JP) ..... 2012-216676

(51) Int. Cl.
*B65H 5/00* (2006.01)
*B65H 5/06* (2006.01)

(52) U.S. Cl.
CPC ..... *B65H 5/062* (2013.01)
USPC ..... 271/10.01; 271/10.09

(58) Field of Classification Search
USPC ..... 271/10.01, 10.09, 10.11, 126, 147
See application file for complete search history.

(56) References Cited

U.S. PATENT DOCUMENTS

2006/0180980 A1* 8/2006 Yonemoto ..... 271/10.11
2006/0180989 A1* 8/2006 Seike et al. ..... 271/121

FOREIGN PATENT DOCUMENTS

JP 11-052650 A 2/1999
JP 2010-055126 A 3/2010

* cited by examiner

*Primary Examiner* — Michael McCullough
(74) *Attorney, Agent, or Firm* — Banner & Witcoff, Ltd.

(57) ABSTRACT

An image forming apparatus has a main body having a sheet feed path and an opening. A sheet placing part defined in the main body. The sheet inserted through the opening is placed on the sheet placing part. A supply roller arranged to face the placing part and feeds the sheet placed on the sheet placing part in a sheet feed direction toward the sheet feed path, a frame arranged to face the sheet placing part and configured to support the supply roller, the frame having a protruded part protruded on an opening side with respect to the supply roller. An image forming unit is provided inside the main body. An inclined surface is formed on a side of the protruded part facing the sheet placing part, and the protruded part has an inclined surface facing the sheet placing part and inclined such that a distance between the inclined surface and the sheet placing part becomes gradually smaller toward the supply roller.

12 Claims, 9 Drawing Sheets

IMAGE FORMING APPARATUS

CROSS-REFERENCE TO RELATED APPLICATION

This application claims priority under 35 U.S.C. §119 from Japanese Patent Application No. 2012-216676 filed on Sep. 28, 2012. The entire subject matter of the application is incorporated herein by reference.

BACKGROUND

1. Technical Field

Aspects of the present invention relate to an image forming apparatus.

2. Prior Art

A conventional image forming apparatus typically has a main body, a sheet placing part, a sheet supply roller and an image forming unit. In the main body, a sheet feed path through which a sheet is fed is formed. On the main body, an opening through which inside and outside of the image forming apparatus communicate. The sheet placing part is defined inside the main body, and sheets, which are inserted in the main body are placed thereon. The sheet ejection roller is arranged at a position opposing to the sheet placing part, and feeds the sheets placed on the sheet placing part toward the sheet feed path. The image forming unit is also provided inside the main body, and forms images on the sheets.

With the above configuration, the conventional image forming apparatus is configured to feed sheets one by one and form an image on each sheet.

SUMMARY

According to the conventional image forming apparatus, the sheets inserted inside the main body through the opening should be sufficiently inserted, in a sheet feed direction, so that part of the sheets contact the sheet supply roller. In such an image forming apparatus, the sheet supply roller is exposed to outside the main body through an opening on the downstream side of the sheet supply roller. Therefore, in such an image forming apparatus, a leading end of the sheet may contact the supply roller when a user attempts to insert the sheet in the main body and the sheet may be buckled.

In consideration of the above problem, aspects of the invention provide an improved image forming apparatus which is capable of suppressing buckling of the sheets when the user attempts to place the same on the sheet placing part.

According to aspects of the invention, there is provided an image forming apparatus, which has a main body having a sheet feed path configured such that a sheet is fed along the sheet feed path and an opening through which an inside and an outside of the main body communicate with each other, a sheet placing part defined in the main body and configured such that the sheet inserted, through the opening, in the main body is placed on the sheet placing part, a supply roller arranged to face the placing part and configured to feed the sheet placed on the sheet placing part in a sheet feed direction toward the sheet feed path, a frame arranged to face the sheet placing part and configured to support the supply roller, the frame having a protruded part which is protruded, in the sheet feed direction, on an opening side with respect to the supply roller, and an image forming unit provided inside the main body and configured to form an image on the sheet, and the protruding part has an inclined surface facing the sheet placing part and inclined such that a distance between the inclined surface and the sheet placing part becomes gradually smaller toward the supply roller.

In the image forming apparatus according to aspects of the invention, a frame is arranged to face the sheet placing part. The frame is configured to support the supply roller and has a protruded part, which protrudes, in a sheet feed direction in which the sheet is supplied toward the sheet feed path, on the opening side with respect to the supply roller. Further, on a surface of the protruded part, facing the sheet placing part, an inclined surface is formed. The inclined surface is configured such that a part on the inclined surface closer the sheet supply roller is closer to the sheet placing part. Therefore, according to the image forming apparatus, when the sheet is inserted in the main body and fed in the feeding direction so that the sheet contacts the sheet supply roller, it is possible to prevent the leading end of the sheet from hitting the sheet supply roller since the leading end of the sheet contacts the inclined surface and proceeds as it becomes closer to the sheet placing part.

Therefore, with the image forming apparatus according to the invention, curving of the sheet placed on the sheet placing part can be suppressed.

BRIEF DESCRIPTION OF THE ACCOMPANYING DRAWINGS

FIG. 5 is a perspective view of the feeding unit holding frame, the sheet supply roller, a separation roller, a roller holder, a pinch roller and the like.

FIG. 6 is a plan view of the feeding unit holding frame, the sheet ejection roller, the separation roller, the roller holder, a pinch roller and the like.

DETAILED DESCRIPTION OF THE EMBODIMENTS

Figure 1:
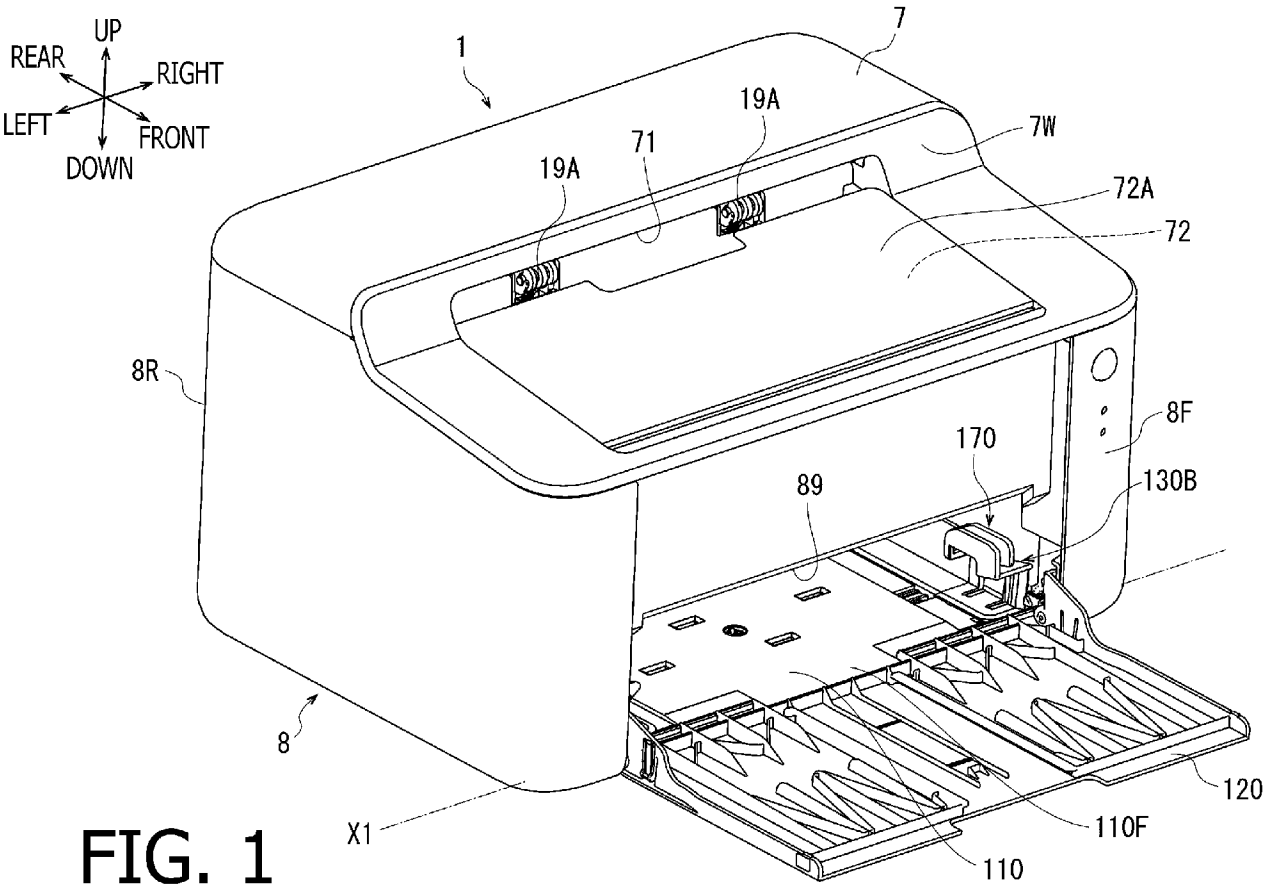
FIG. 1 is a perspective view of an image forming apparatus according to an embodiment of the invention.

Hereinafter, an exemplary embodiment will be described, referring to the drawings.

An image forming apparatus 1 shown in FIG. 1 is an exemplary embodiment of the present invention. In FIG. 1, a side of the image forming apparatus 1 where an opening 89 is formed is defined as a front side of the image forming apparatus 1. Facing the opening 89, a left-hand side of the image forming apparatus 1 is defined as a left-side of the image forming apparatus 1. The other directions are defined similarly and are indicated in FIG. 1 and the other drawings.

<Schematic Structure of Image Forming Apparatus>

Figure 2:
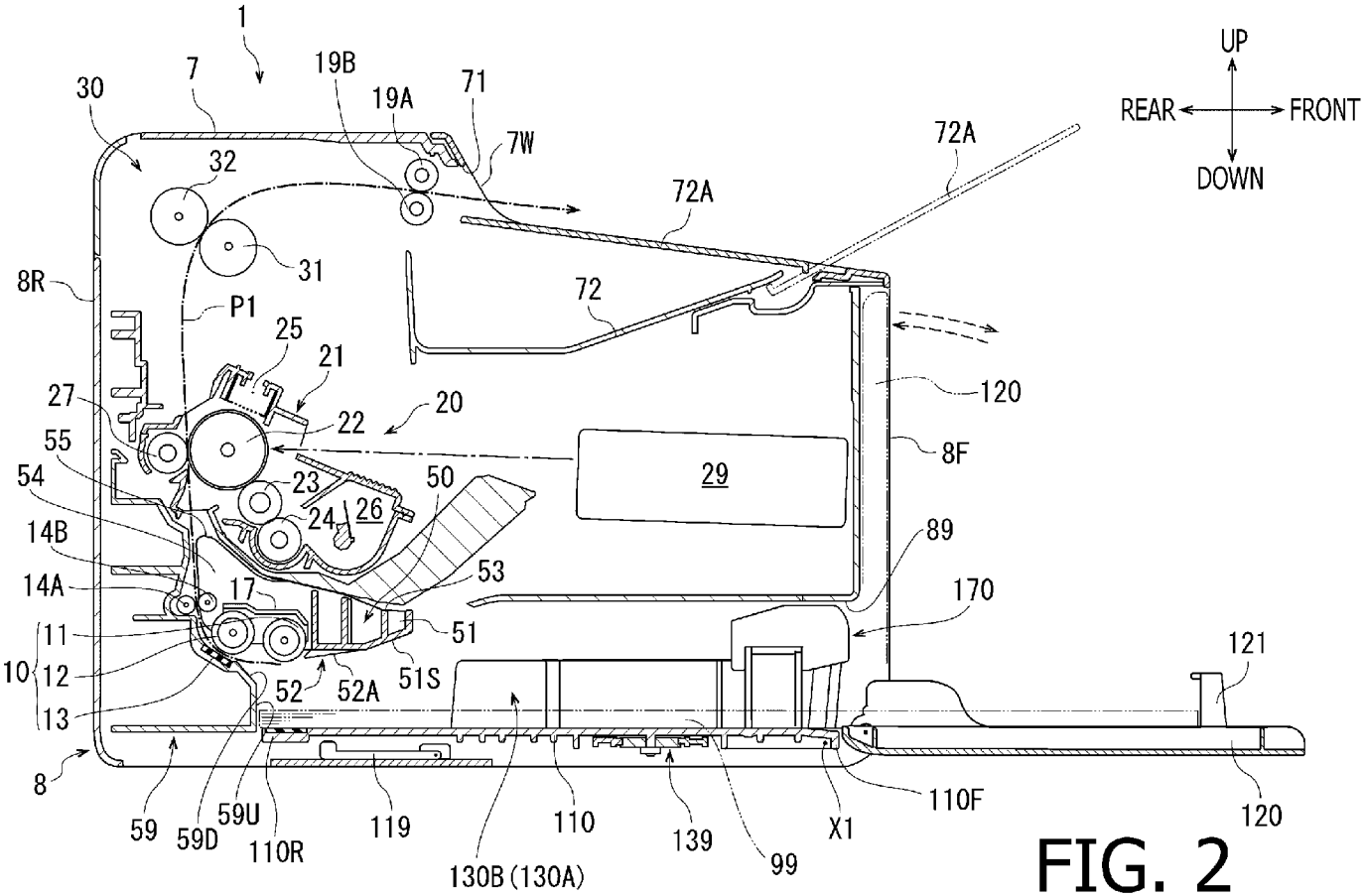
FIG. 2 is a partial side view of a part of the image forming apparatus shown in FIG. 1.

The image forming apparatus 1 is a monochrome laser printer. As shown in FIGS. 1 and 2, the image forming apparatus 1 has a main body 8, a sheet feed unit 10, a drive roller 14A, a pinch roller 14B, a feeding unit holding frame 50, a movable (openable/closable) tray 120, a platen 110, side guides 130A and 130B, an image forming unit 20, a pair of ejection rollers 19A and 19B.

Figure 3:
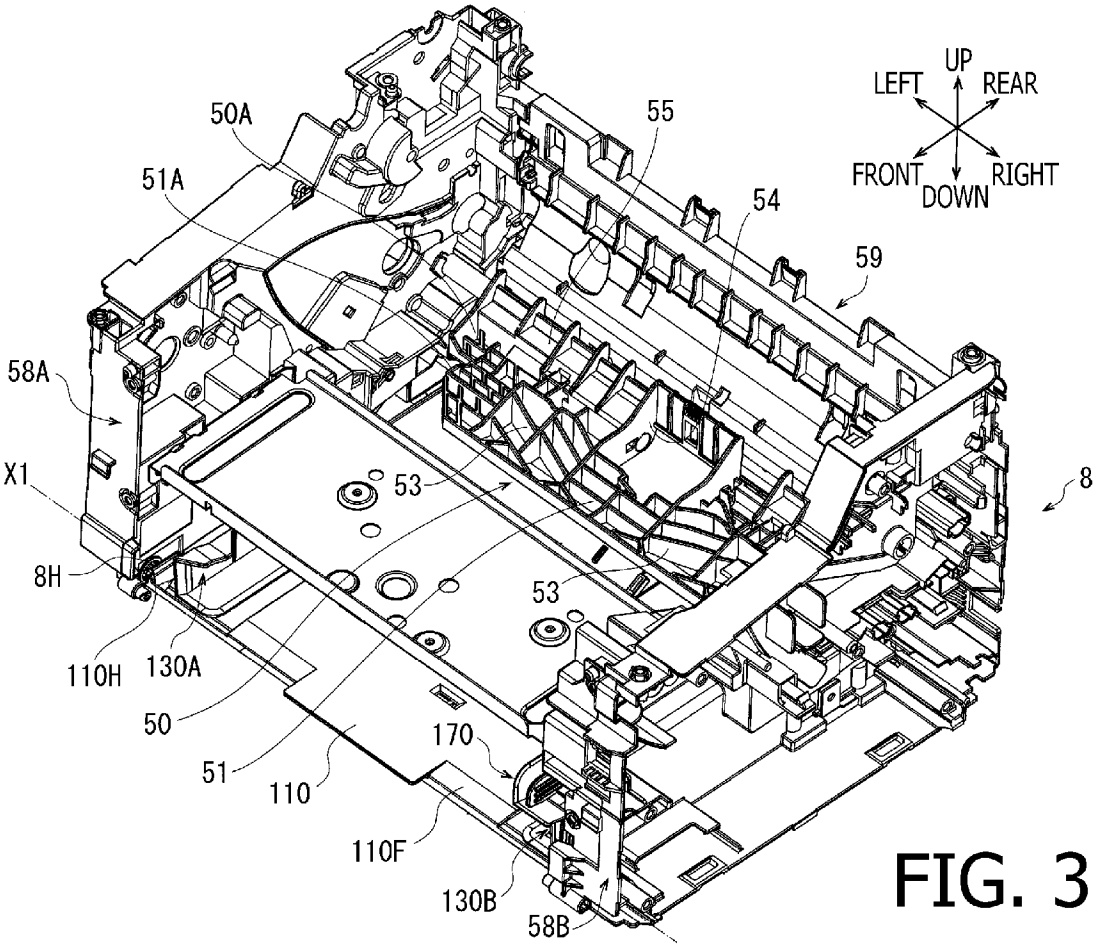
FIG. 3 is a perspective view of side frames, a feeding unit holding frame, a pressure plate, a side guide, and the like of the image forming apparatus shown in FIG. 1.

The main body 8 has a substantially box-like shape. A rear side surface 8R is higher than a front side surface 8F, and an upper surface of the main body 8 is formed to have a step so that a rear side portion of the main body 8 is higher than a front side portion of the main body 8 (see FIG. 2). As shown in FIGS. 2 and 3, inside the main body 8, a pair of (right and left) side frames 58B and 58A, a sheet feed chute 59, a feeding unit holding frame 50, other frames and the like are provided.

As shown in FIGS. 1 and 2, on a lower portion of the front surface 8F, an opening 89 is formed. Through the opening 89, inside and outside of the main body communicate with each other. On an upper side of the main body 8, a body cover 7 configuring an upper outside face of the main body 8 is provided. The body cover 7 is formed to have a crank-like bent when viewed from a side to meet the stepped shape of the main body 8.

A front side portion of the body cover 7, a sheet ejection tray 72 is formed on the upper surface thereof. Further, on the body cover 7, an auxiliary tray 72A is provided. The auxiliary tray 72A is displaceably supported by the body cover 7 so as to be located at a position where the auxiliary tray 72A extends frontward with respect to the ejection tray 72 as shown by two-dotted line in FIG. 2, and at a position where the auxiliary tray 72A covers the ejection tray 72 from above as shown by solid line in FIG. 2.

As shown in FIGS. 1 and 2, an upright wall surface 7W which is bent upright is formed at a rear end of the ejection tray 72. On the upright surface 7W, an ejection opening 71 is formed, through which inside and outside of the main body communicate with each other.

As shown in FIG. 3, the side frames 58B and 58A extend in front/rear and up/down directions, i.e., extend along right and left surfaces of the main body 8, respectively.

As shown in FIGS. 2 and 3, the sheet feed chute 59 extends, inside the main body 8, in the front/rear and right/left directions so as to extend along the rear surface 8R. A left side end of the sheet feed chute 59 is connected to the left side frame 58A, and a right side end of the sheet feed chute 59 is connected to the right side frame 58B.

As shown in FIG. 2, the sheet feed chute 59 has a vertical surface 59U and an inclined surface 59D. The vertical surface 59U is spaced from the rear surface 8R in the front direction, and rises upright from the bottom of the main body 8. The inclined surface 59D inclines upward from the upper end of the vertical surface 59U toward the rear surface 8R.

As shown in FIGS. 2-6, the feeding unit holding frame 50 is arranged above and on a front side with respect to the inclined surface 59D of the sheet feed chute 59, and extends in the right and left direction to have an elongated shape. The feeding unit holding frame 50 is an integrally molded resin member. The feeding unit holding frame 50 is located at a position to face the platen 110 from the above. The feeding unit holding frame 50 has a main part 55 and a protruded part 51.

Figure 6:
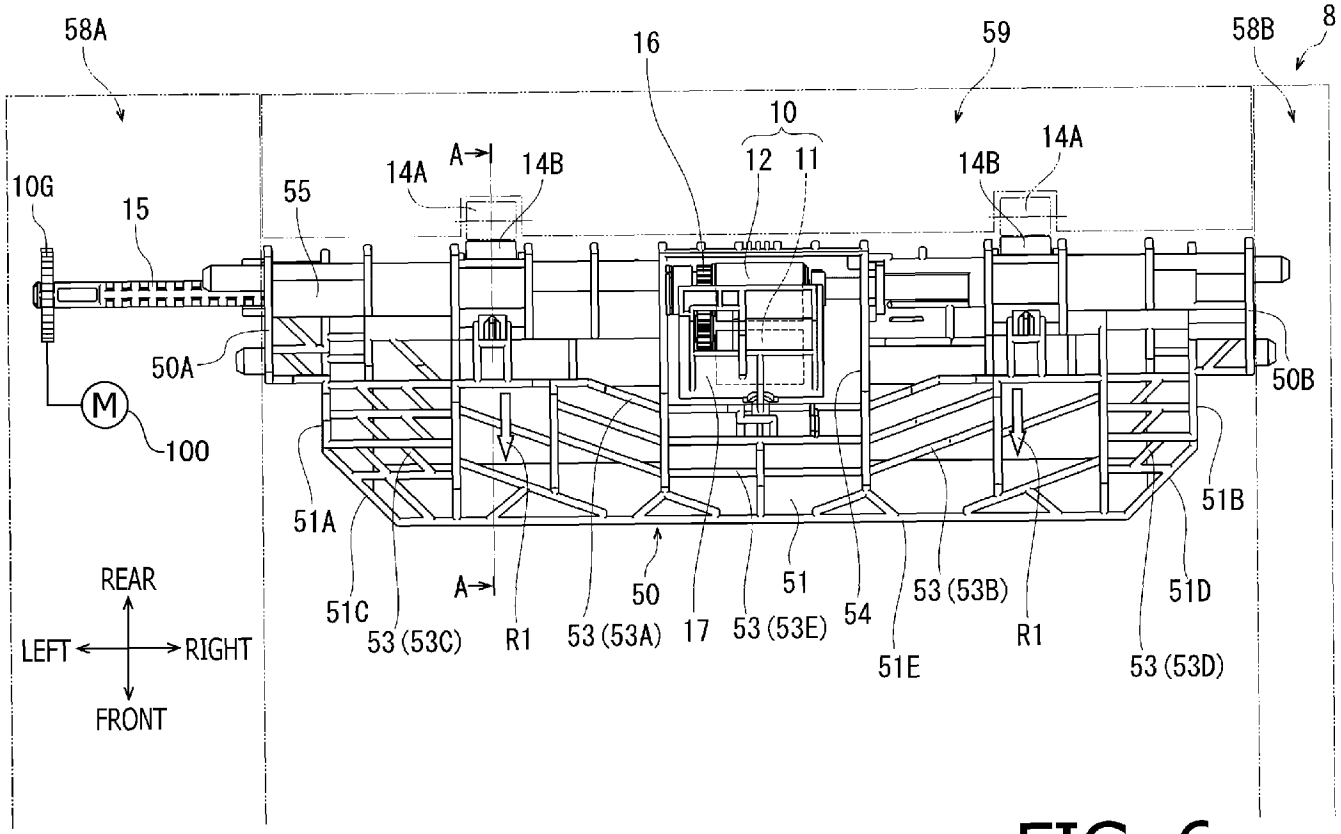

Specifically, as shown in FIGS. 3 and 6, a left side end 50A at a rear side of the feeding unit holding frame 50 is connected to the left side frame 58A, and a right side end 50B at the rear side of the feeding unit holding frame 50 is connected to the right side frame 58B. A portion extending from the left side end 50A to the right side end 50B is a main part 55 of the feeding unit holding frame 50.

Figure 4:
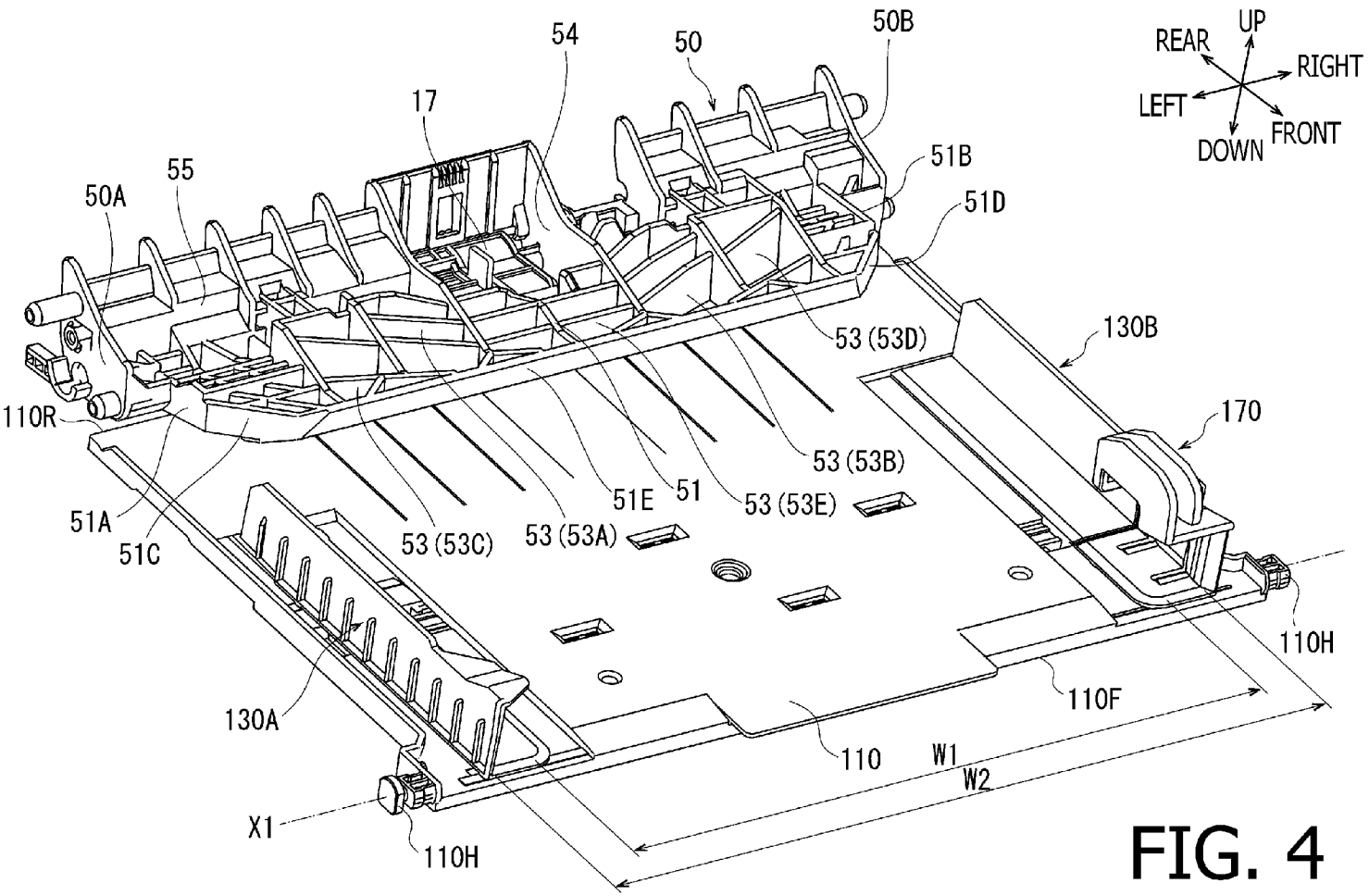
FIG. 4 is a perspective view of the feeding unit holding frame, the pressure plate, the side guide and the like of the image forming apparatus.
Figure 5:
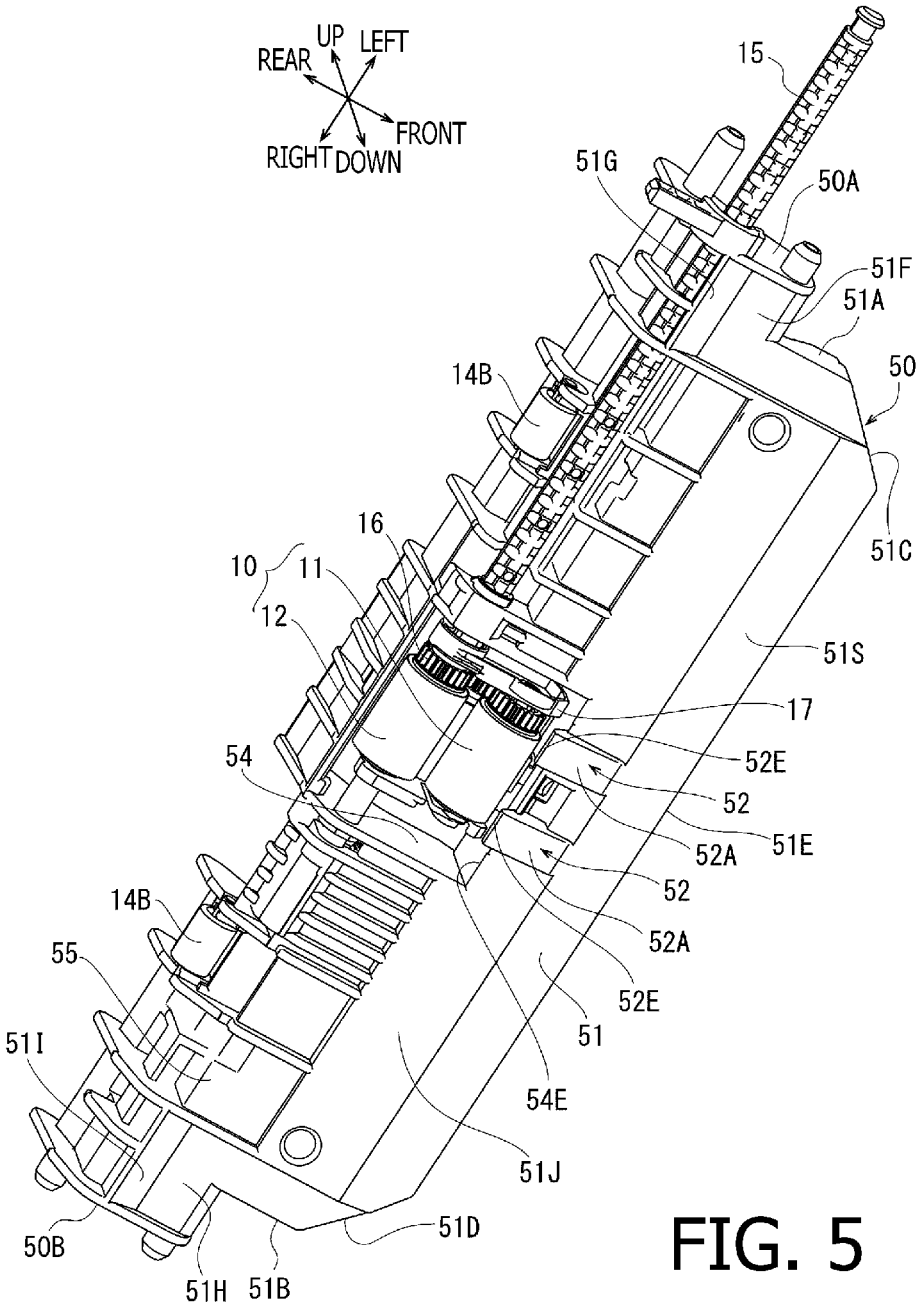

As shown in FIGS. 4-6, a left end part 51A defined at a front side of the feeding unit holding frame 50 is located on the front side with respect to the left side end 50A, and is located rightward with respect to the left side end 50A to define a rectangular recess. A right end part 51B defined at the front side of the feeding unit holding frame 50 is located on the front side with respect to the right side end 50B, and is located leftward with respect to the right side end 50B to define a rectangular recess. On the feeding unit holding frame 50, inclined parts 51C and 51D are formed. The inclined parts 51C and 51D extend frontward from the front end of the left end part 51A and the front end of the right end part 51B, respectively, and extend to approach each other in the right and left direction. Further, on the feeding unit holding frame 50, a front end part 51E which extends in the right and left direction to connect the front end of the inclined part 51C and the front end of the inclined part 51D.

A protruded part 51 is a part of the feeding unit holding frame 50, forwardly protruded from the main part 55, and extending from the left end part 51A and the inclined part 51C to the right end part 51B and the inclined part 51D. As shown in FIG. 2, the protruded part 51 is protruded on the opening 89 side, in the front-and-rear direction, with respect to the sheet supply roller 11.

As shown in FIGS. 4 and 6, a plurality of ribs 53 are formed on the protruded part 51. Each rib 53 extends from the left end part 51A side to the right end part 51B, and formed to start curving on the opening 89 side, in the front-and-rear direction, so that it surrounds the sheet supply roller 11.

Specifically, ribs 53E, which are arranged to overlap the sheet supply roller 11 in the right-and-left direction but spaced in the front-and-rear direction, extend in the right-and-left direction which is parallel to a direction in which the front end part 51E extends. Ribs 53C which overlap the inclined parts 51C in the right-and-left direction, but spaced therefrom in the front-and-rear direction extend in parallel with the inclined parts 51C. Ribs 53D which overlap the inclined part 51D in the right-and-left direction but spaced in the front-and-rear direction extend in parallel with the inclined parts 51D. Ribs 53A located between the ribs 53E and ribs 53C, in the right-and-left direction, are formed so that inclination angle thereof with respect to the right-and-left direction is smaller than that of the ribs 53C. Ribs 53B located between the ribs 53E and ribs 53D, in the right-and-left direction, are formed so that inclination angle thereof with respect to the right-and-left direction is smaller than that of the ribs 53D. In other words, the ribs arranged at farther positions with respect to the sheet supply roller 11, in the right-and-left direction, are formed such that the inclination angle with respect to the right-and-left direction is greater.

As shown in FIG. 4, height of the ribs 53E, 53A and 53B located on an inner side, in the right-and-left direction, is greater than the height of the right and left ribs 53D and 53C.

As shown in FIG. 2, in the main body 8, a sheet feed path P1 through which the sheet 99 is fed is defined. The sheet feed path P1 extends from an upper end of the vertical surface 59U of the feeding chute 59 toward the rear surface 8R along the inclined surface 59D. The sheet feed path P1 is then turned upward and extends substantially vertically. The sheet feed path P1 changes it extending direction below the body cover 7 to be directed frontward and extends toward the ejection opening 71 and reaches the sheet ejection tray 72.

The sheet feed unit 10 includes the sheet supply roller 11, a separation roller 12 and a separation pad 13. The sheet supply roller 11 and the separation roller 12 are accommodated inside a receiving portion 54 of the feeding unit holding frame 50, in the vicinity of the rear surface 8R.

More specifically, as shown in FIGS. 3-6, at a central portion, in the right-and-left direction of the main part 55 of the feeding unit holding frame 50, the receiving portion 54 which is a rectangular recessed portion is formed. The receiving portion 54 is formed to have an opening on the rear surface 8R side with respect to the protruded portion 51. The receiving portion 54 penetrates the main part 55 in the up-and-down direction.

As shown in FIGS. 5 and 6, the main part 55 rotatably supports a shaft 15. The shaft 15 extends on the left side with respect to the left side end 50A. At the left end portion of the shaft 15, a driving gear 10G is secured so that the driving gear 10G rotates integrally with the shaft 15.

The right end portion of the shaft 15 protrudes inside the receiving portion 54 by a predetermined amount, and engages with a separation roller 12. Inside the receiving portion 54, a roller holder 17 is provided. The roller holder 17 is inserted in the receiving portion 54, and supported by the feeding unit holding frame 50 with the shaft 15 being inserted. The roller holder 17 supports the separation roller 12 by surrounding the same from the right and left sides. Further, the roller holder 17 extends frontward and rotatably supports the sheet supply roller 11. To the roller holder 17, a transmission gear train 16 is provided. The transmission gear train 16 transmits a rotation of the separation roller 12 to the sheet supply roller 11.

The left end portion 15A of the shaft 15 extends on the left side of the left side end 50A of the feeding unit holding frame 50, and the driving gear 10G is secured at the left end portion 15A of the shaft 15. A rotational driving force is input from a drive source (e.g., a motor) 100 to the driving gear 10G, and the rotational driving force is transmitted to the separation roller 12 through the shaft 15.

As shown in FIG. 2, the separation roller 12 is arranged on the front side of the feeding chute 59, and faces the inclined surface 59D. Further, the separation roller 12 is located on the rear surface 8R side with respect to the feeding roller 11. The feeding roller 11 is arranged at a position to face a rear end portion 110R of the platen 110 from the above.

A separation pad 13 is provided on the inclined surface 59D at a position to face the separation roller 12 with the feeding path P1 being located therebetween. The separation pad 13 is urged toward the separation roller 12.

The drive roller 14A and the pinch roller 14B are arranged above the separation roller 12 and the separation pad 13, respectively, and face each other with the sheet feed path P1 being located therebetween.

Specifically, one pair of the drive roller 14A and the pinch roller 14B is provided on the left side of the feeding roller 11, and another pair is provided on the right side of the feeding roller 11.

The drive roller 14A is rotatably supported by the feeding chute 59. A rotational driving force is input from the driving source 100 inside the main body 8 to the drive roller 14A so that the supply roller 11 and the separation roller 12 rotate synchronously.

Figure 8:
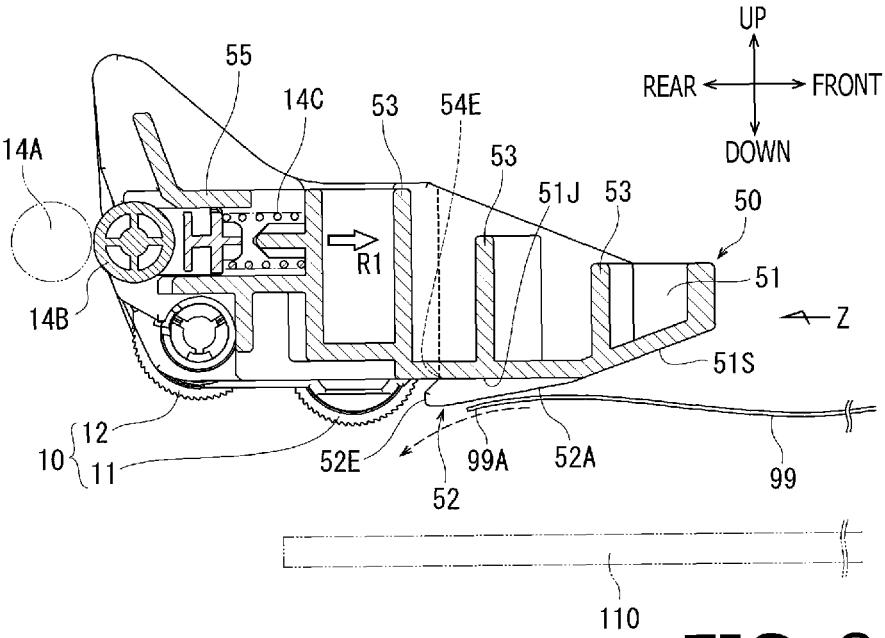
FIG. 8 is a cross-sectional side view taken along line A-A of FIG. 6.

As shown in FIGS. 5, 6 and 8, the pinch roller 14B is rotatably supported by the main part 55 of the feeding unit holding frame 50. The pinch roller 14B faces the drive roller 14A from the opening 89 side.

As shown in FIG. 8, between the main pat 55 and the pinch roller 48, a compression coil spring 14C is provided with being compressed. A front end portion of the compression coil spring 14C is supported by the main part 55. The compression coil spring 14C urges the pinch roller 14B toward the drive roller 14A. With this configuration, the pinch roller 14B is urged to abut the drive roller 14A and driven, by the drive roller 14A, to rotate.

As shown in FIGS. 5 and 6, the left end part 51A of the protruded part 51 is located on the left side with respect to the left side pinch roller 14B. The right end part 51B of the protruded part 51 is located on the right side with respect to the right side pinch roller 14B. Thus, the protruded part 51 is formed continuously from the position on the left side of the pinch roller 14B to the position on the right side of the right side pinch roller 14B.

The front end part 51E extends on the left side of the left side pinch roller 14B. Further, the front end part 51E extends on the right side of the right side pinch roller 14B. With this configuration, as the left end part 50A and the right end part 50B are connected to the side frames 58A and 58B, respectively, the feeding unit holding frame 50 is hardly bendable.

As shown in FIGS. 1 and 2, the openable/closable tray 120 is a planar plate-like member rockably supported by the main body 8 at a lower end portion of the front surface 8F. When the openable/closable tray 120 is opened and extends substantially horizontally, the opening 89 is exposed to outside. It is noted that the position of the tray 120 shown in FIG. 1 or the position of the tray indicated by solid lines in FIG. 2 is defined as an open position. The tray 120 can be moved to an upright position indicated by two-dotted lines in FIG. 2 at which the opening 89 is closed by the tray 120. Thus, the position of the tray 120 indicated by the two-dotted lines in FIG. 2 will be referred to as a closed position.

The platen 110 is a planar plate-like member which extends, at a bottom portion inside the main body 8, from the front surface 8F side toward the rear surface 8R side. A plurality of sheets 99, which are inserted in the main body 8 through the opening, are placed in a stacked manner. When the tray 120 is located at the open position, the tray 120 is located on the front side with respect to the platen 110 and supports a portion of the stacked sheets 99 protruded frontward from the opening 89 from below.

As shown in FIG. 4, a pair of right and left shaft parts 110H is provided to a front end part 110F of the platen 110, which is a part closer to the front surface 8F of the main body 8. As shown in FIG. 3, the pair of shaft parts 110H is rockably supported by a pair of right and left supporting parts 8H provided at lower corners at front end portions of the side frames 58B and 58A, respectively. In FIG. 3, only the left side shaft part 110H and the left side supporting part 8H are shown. The right side shaft part 110H and the right side supporting part 8H have the similar structures. With this configuration, the platen 110 is supported by the main body 8 such that the platen 110 is rockable about an axis X1 which extends in the right-and-left direction.

As shown in FIG. 2, an rear end part 110R closer to the rear surface 8R face the vertical surface 59U of the feeding chute 59 in the front-and-rear direction. As the platen 110 rocks about the axis X1, the rear end part 110R displaces, below the sheet supply roller 11, in the up-and-down direction.

Figure 7:
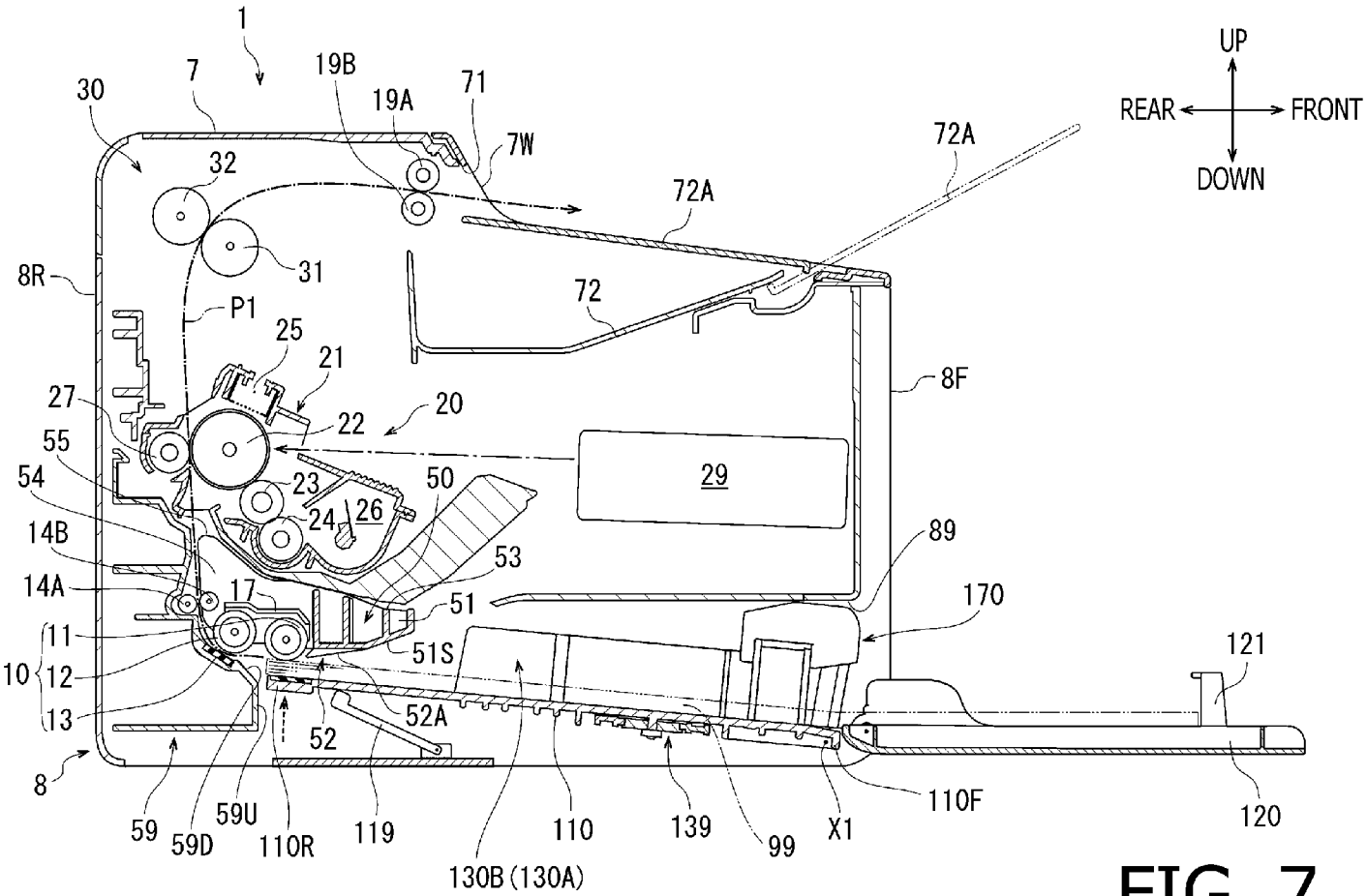
FIG. 7 is a cross-sectional side view of the image forming apparatus schematically illustrating a sheet feed operation.

Below the platen 110, a displacing mechanism 119 is provided. The displacing mechanism 119 extends substantially horizontally toward the rear side. When he image forming apparatus 1 forms the image formation process, the displacing mechanism is controlled by a controlling unit (not shown) to rotate and is displaced to be upwardly inclined toward the rear side as shown in FIG. 7. When the image formation process is finished, the displacing mechanism 119 returns to a status shown in FIG. 2.

The image formation process is performed on the sheet 99 placed on the platen 110 as follows. The displacing mechanism 119 rotates and the platen 110 is moved to the closer position. Then, the uppermost sheet 99 placed on the platen 110 contacts the sheet supply roller 11. The sheet supply roller 11 is controlled by the not-shown controlling unit and rotates with contacting the sheet 99. Then, the sheet 99 on the platen 110 is fed from the front side toward the rear side. With this control, the sheet supply roller 11 feeds the sheet 99 on the platen 110 to the sheet feed path P1. According to the exemplary embodiment, the direction in which the sheet 99 is fed to the sheet feed path P1 is the front-and-rear direction. An upstream side in the sheet feed direction is the front surface 8F side of the main body 8, while a downstream side in the sheet feed direction is the rear surface 8R side of the main body 8.

As shown in FIGS. 2 and 4, the side guides 130A and 130B are provided to the platen 110 such that they are slidable in the right-and-left direction. The side guides 130A and 130B are upright plate members which face each other in the right-and-left direction, and each of which extends in the front-and-rear direction.

As shown in FIG. 2, on a back surface of the platen 110, a rack-and-pinion mechanism 139 is provided. The rack-and-pinion mechanism 139 is connected to the side guides 130A and 130B. With this structure, the side guides 130A and 130B interlock such that they mutually approach or separate in the right-and-left direction on the platen 110. By adjusting the positions in the right-and-left direction of the side guides 130A and 130B, the position of the sheet 99 in the right-and-left direction can be adjusted. According to the exemplary embodiment, the right-and-left direction is the width direction of the sheet 99.

Incidentally, as shown in FIG. 2, on the upper surface of the tray 120 when located at the opened position, an end guide 121 is provided to be slidable in the front-and-rear direction. By appropriately moving the end guide 121 in the front-and-rear direction, an amount of the sheet 99 protruded from the opening 89 can be restricted.

As shown in FIGS. 1, 2 and 4, an operation part 170 is integrally formed on the right side guide 130B. The operation part 170 extends from an upper end side of the right side guide 130B and a front end portion 130F side to the vicinity of the front surface 8F of the main body 8.

By pinching the operation part 170 and moving the same in the right-and-left direction, the side guide 130B slides integrally in the right-and-left direction. Then, via the rack-and-pinion mechanism 139, the moving force to the right side guide 130B is transmitted to the left side guide 130A. Thus, the side guides 130A and 130B mutually approach or separate on the pressure plate in the right-and-left direction. As above, with the side guides 130A and 130B, positioning of the sheet 99 can be done for a sheet width range of a first width W1 to a second width W2.

According to the exemplary embodiment, the first width W1 corresponds to the width of an A4 sheet (i.e., 210 mm) and the second width W2 corresponds to the width of a letter size sheet (i.e., 216 mm). Thus, the positions of the side guides 130A and 130B are switched between the positions for the A4 size and the positions for the letter size, on the platen 110.

As shown in FIG. 2, when the displacing mechanism 119 is in a non-rotate state, the platen 110 extends substantially horizontally. In this state, the platen 110 is spaced from the sheet supply roller 11 downwardly. When the displacing mechanism 119 rotates and is displaced to be in an upwardly inclined state toward the front side, the platen 110 is lifted up by the displacing mechanism 119 from the spaced position, and approaches the sheet supply roller 11 as shown in FIG. 7. The close position varies depending on the number of the sheets 99 accumulated on the platen 110. The side guides 130A and 130B are displaced integrally with the platen 110 displacing between the spaced position and the close position.

As shown in FIG. 2, the image forming unit 20 includes a process cartridge 21, a scanner unit 29 and a fixing unit 30.

The process cartridge 21 is arranged at an upper portion of the feeding unit holding frame 50. The process cartridge 21 is a box-like member extending in the right-and-left direction. A vertical portion of the sheet feed path P1 is included in the process cartridge 21. Inside the process cartridge 21, a photoconductive drum 22, a transfer roller 27, a developing roller 23, a supplying roller 24, a container 26, a charter 25 and the like are included.

The photoconductive drum 22 is a cylindrical member extending in the right-and-left direction. The photoconductive drum 22 faces the vertical part of the sheet feed path P1 from the front side. The transfer roller 27 faces the photoconductive drum 22 with the vertical part of the sheet feed path P1 located therebetween. The photoconductive roller 22 and the transfer roller 27 rotate synchronously with sandwiching the sheet 99, which is fed through the vertical part of the sheet feed path P1, at the nip therebetween. The container 26 contains toner to be supplied to the photoconductive drum 22. The supplying roller 24 supplies the toner to the developing roller 23 from the container 26. The developing roller 23 supplies the toner to the photoconductive drum 22 to develop an electrostatic latent image formed on the photoconductive drum 22. The charger 25 extends in the right-and-left direction and is arranged to be parallel with the photoconductive drum 22 with being spaced upward from the photoconductive drum 22. The charger causes the photoconductive drum 22 to be positively charged by corona discharging.

The scanner unit 29 is arranged on a front side of the process cartridge 21. The scanner unit 29 includes a laser source, a polygonal mirror, an fθ lens, mirrors and the like, and emits a laser beam to the photoconductive drum 22 located on the rear side of the process cartridge 21.

The fixing unit 30 is arranged on an upper side of the photoconductive drum 22 and the transfer roller 27 at the vertical part of the sheet feed path P1. The fixing unit 30 includes a heat roller 31 facing the sheet feed path P1 from the front side, and a pressure roller opposing to the heat roller 31 with the sheet feed path P1 located therebetween.

A pair of ejection rollers 19A and 19B is arranged at a most downstream side of the sheet feed path P1. That is, the pair of ejection rollers 19A and 19B is arranged at a position where the sheet feed path P1 changes its extending direction toward the front side, and faces the ejection opening 71. The ejection roller 19A and the ejection roller 19B face each other with the sheet feed path P1 located therebetween.

<Inclined Surface and Guiding Surface>

As shown in FIGS. 2, 5 and 8, on a side of the projecting part 51 facing the platen 110, an inclined surface 51S is formed. The inclined surface 51S faces the pressure plate 11 from the above, and downwardly inclined from the lower end of the front end part 51E toward the rear surface 8R. That is, the inclined surface 51S is inclined such that a portion, between the opening 89 and the sheet supply roller 11, on the inclined surface 51S is closer to the platen 110 as the portion is closer to the sheet supply roller 11.

As shown in FIG. 5, on a side of the projection part 51 facing the platen 110, a bottom surface 51J, which is connected to the rear end of the inclined surface 51S and extending substantially horizontally, is formed. On both sides, in the right-and-left direction, of the feeding unit holding frame 50, recesses 51F and 51H, which are recessed upward with respect to the bottom surface 51J, are formed. The inclined surface 51S extends, the right-and-left direction, from the left recess 51F to the right recess 51H.

As shown in FIGS. 2, 5, 8 and 9, on a side of the projecting part 51, opposite to the platen 110, a right-and-left pair of guide parts 52 is formed. The pair of guide parts 52 is protruded upward from the bottom surface 51J. A lower surface 51A of the protruding part 51 is downwardly inclined toward the rear surface 8R, and faces the platen 110 from the above. The lower surface 51A and the inclined surface 51S form a continuous and downwardly inclined surface. The pair of guide parts 52 protrudes toward the platen 110 at a position between the inclined surface 51S and the sheet supply roller 11, in the front-and-rear direction, and inclines such that, between the inclined surface 51S and the sheet supply roller 11, a portion closer to the sheet supply roller 11 is closer to the platen 110. Further, an inclination angle of the lower surface 51A of the protruding part 51 is slightly smaller than and downward inclination angle of the inclined surface 51S.

Figure 9:
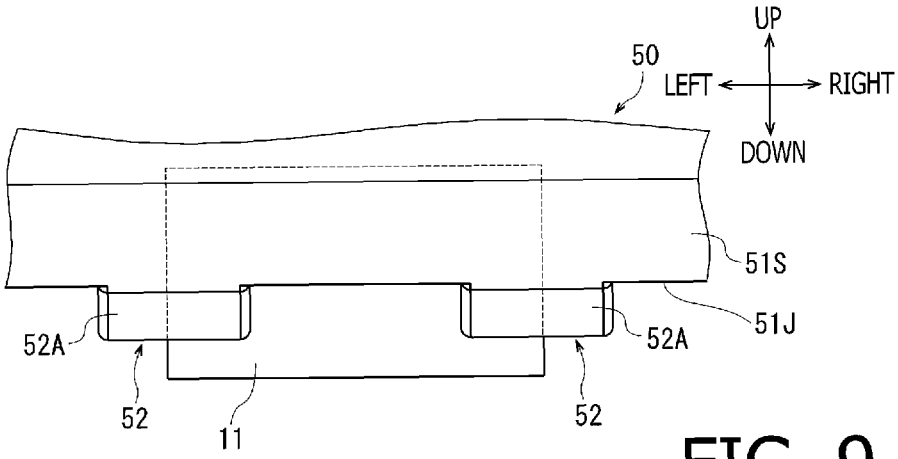
FIG. 9 is a partial front view of the image forming device viewed along arrow Z in FIG. 8.

As shown in FIG. 9, when viewed along the front-and-rear direction, the left side guide part 52 overlaps the left end of the sheet supply roller 11, and the right side guide part 52 overlaps the right end of the sheet supply roller 11.

As shown in FIGS. 5 and 8, the rear end side 52E of the pair of guide parts 52 is located on the rear surface 8R side with respect to a front end 54E of the receiving portion 54. That is, the pair of guide parts 52 is protruded, in the front-and-rear direction, toward the sheet supply roller 11 with respect to the opening 89 side end 54E of the receiving portion 54. Further, as shown in FIG. 8, the rear end 52E of the pair of guide parts 42 is located on an upper side with respect to the lower end of the sheet supply roller 11.

As shown in FIG. 5, the recesses 51F and 51H are formed at portions overlapping the left and right ends of the A4 size sheet 99 when it is fed. When the sheet 99 is fed, both ends in the right-and-let direction tend to flip-flop. If both ends of the sheet 99 contact the feeding unit holding frame 50, unnecessary feeding resistance may occur. By forming the recesses 51F and 51*h*, that is, by forming the portions of the feeding unit holding frame 50 upwardly recessed with respect to the bottom surface 51J even if the right and left side ends of the sheet 99 may flip-flop, the sheet 99 may not contact the feeding unit holding frame 50, and the sheet 99 can by fed in a stabilized condition.

At rear side ends of the recesses 51F and 51*h*, guide surfaces 51G and 51I are formed. The guide surfaces 51G and 51I are downwardly inclined and guide the left and right side ends of the sheet 99 toward the feeding path P1. By the guide surfaces 51G and 51H, even if the left and right side ends of the sheet flip-flop, the sheet 99 can be fed toward the feeding path P1 in stabilized manner.

<Image Forming Process>

The image forming apparatus 1 is configured to form an image on the sheet 99 placed on the platen 110 as follows. When the not-shown control unit starts controlling, the displacing mechanism 119 move the platen 110 from the spaced position shown in FIG. 2 to the close position shown in FIG. 7. Then, as shown in FIG. 7, the sheet 99 mounted on the platen 110 contacts supply roller 11.

Next, the supply roller 11, the separation roller 12, the drive roller 14A, the image forming unit 20, the scanner unit 29, the fixing unit 30 and the pair of ejection rollers 19A and 19B operate in an associated manner. Then, the supply roller 11 feeds the sheet 99 contacting therewith toward the sheet feed path P1. the inclined surface 59D of the feeding chute 59 contacts the sheet 99 being fed from below, and guides the sheet 99 so that the sheet 99 is fed along the sheet feed path P1. The separation roller 12, in association with the separation pad 13, separates the sheets 99 to be fed one by one. The drive roller 14A and the pinch roller 14B feed the separated sheet 99 toward the process cartridge 21.

Next, the photoconductive drum 22 rotates and its circumferential surface is uniformly charged by the charger 25. Then, the photoconductive drum 22 is exposed to the laser beam emitted by the scanner unit 29. Thus, the scanner unit 29 forms an electrostatic latent image, which corresponds to the image to be formed on the sheet 99, on the circumferential surface of the photoconductive drum 22. The developing roller 23 and the supply roller 24 supply the toner from the container 26 to the electrostatic image on the circumferential surface of the photoconductive drum 22. Thereby, a toner image corresponding to the electrostatic image is carried on the surface of the photoconductive drum 22. As the circumferential surface of the photoconductive drum 22, which is being rotated, contacts the sheet 99, which is being fed, and a negative voltage applied to the transfer roller 27 acts on the sheet 99, the toner image carried by the photoconductive drum is transferred onto the sheet 99.

The sheet 99 on which the toner image 99 has been transferred is further fed substantially vertically along the sheet feed path P1 and reaches the fixing unit 30. At the fixing unit 30, the heat roller 31 applies heat to the sheet 99, while the pressure roller 32 urges the sheet 99 toward the heat roller 31 (i.e., the sheet 99 is nipped between the heat roller 31 and the pressure roller 32 and a pressure is applied to the sheet 99). With this configuration, the fixing unit 30 fixes the toner image on the sheet 99. Thereafter, the sheet 99 is fed by the pair of ejection rollers 19A and 19B, and ejected toward the ejection tray 72 through the ejection opening 71. Then, the image forming apparatus 1 finishes the image forming process to form an image on the printing sheet.

<Effects>

The image forming apparatus 1 according to the exemplary embodiment is configured such that the protruded port 51 is protruded on the opening 89 side with respect to the sheet supply roller 11 in a direction where the sheet 99 is fed toward the sheet feed path P1, or in the front-and-rear direction, as shown in FIG. 2 or FIG. 8. The inclined surface 51S and the guiding part 52 are formed on a side opposite to the platen 110 with respect to the protruded part 51. The inclined surface 51S and the lower surface 52A of the guiding part 52 are downwardly and continuously inclined such that a portion farther from the opening and closer to the feeding roller 11 side is closer to the platen 110. Thus, in the image forming apparatus 1, as show in FIG. 8, when the sheet 99 is inserted, through the opening 89, in the main body 8, and feed the sheet 99 to a position at which the sheet 99 contacts the sheet supply roller 11, the leading end of the sheet 99A contacts the inclined surface 51S, and proceeds so as to approach the platen 110. When the leading end 99A of the sheet 99 contacts the inclined surface 51S, the leading end 99A contacts the lower surface 52A of the guiding part 52 and proceeds so as to approach the platen 110. Therefore, in this image forming apparatus 1, the leading end 99A of the sheet 99 hardly abuts the sheet supply roller 11.

Therefore, the image forming apparatus 1 according to the exemplary embodiment can suppress bending of the sheet 99 that is placed on the platen 110.

In the image forming apparatus 1 according to the embodiment, as shown in FIG. 9, the right and left guide parts 92 overlap the right and left end portions of the sheet supply roller 11 when viewed from the front-and-rear direction. With this configuration, the guide part 52 can be made as small as possible without deteriorating the effect thereof.

In the image forming apparatus 1 according to the exemplary embodiment, a reactive force R1 of the compression coil spring 14C which urges the pinch roller 14B toward the drive roller 14A acts such that a central part, in the right-and-left direction, of the feeding unit holding frame 50 is deflected, in the front-and-rear direction, toward the opening 89. In the image forming apparatus 1, the main body 55 of the feeding unit holding frame 50 is connected to the right and left side frames 58B and 58A at the right and left end sides 50B and 50A, respectively. The protruded part 51 of the feeding unit holding frame 50 protrudes, in the front-and-rear direction, on the opening 89 side with respect to the sheet supply roller 11. The protruded part 51 is formed continuously from a left side of the left-side pinch roller 14B to a right side of the right-side pinch roller 14B. Therefore, the protruded part 51 serves to receive the reactive force R1 of the compression coil spring 14C and reinforce the feeding unit holding frame 50. As a result, in the image forming apparatus 1, it is ensured that deformation of the feeding unit holding frame 50 can be suppressed. Further, in the image forming apparatus 1, since the feeding unit holding frame 50 is made of resin, the above-described shape of the feeding unit holding frame 50 can easily be formed.

Further, as shown in FIGS. 4 and 6, the image forming apparatus 1 has ribs 53 for enforcement in the protruded part 51. The ribs 53 extend from the left end part 51A side to the right end part 51B side, and curved to surround the sheet supply roller 11 from the opening 89 side. With this configuration, the ribs 53 effectively reinforce the protruded part 51. Accordingly, in the image forming apparatus 1, it is ensured that the protruded part 51, which is reinforced by the ribs 53, receives the reactive force R1 of the compression coil spring 14C. As a result, in the image forming apparatus 1, it is ensured that the deformation of the feeding unit holding frame 50 is suppressed.

In the image forming apparatus 1, the guiding part 52 protrudes, with respect to a side part 54E of the opening 89 of the receiving portion 54 in the front-and-rear direction, as show in FIG. 8. That is, a rear end 52E of the guide part 52 is close to the sheet supply roller 11, in the front-and-rear direction. With this configuration, in the image forming apparatus 1, when the sheet 99 is inserted in the main body 8 and fed, in the front-and-rear direction, to a position at which the sheet 99 contacts the sheet supply roller 11, the leading end 99A of the sheet 99 can contact the lower surface 52A in the vicinity of the sheet supply roller 11. Therefore, in the image forming apparatus 1, the leading end 99A of the sheet 99 hardly contacts the sheet supply roller 11.

In the description above, the present invention is described with reference to the exemplary embodiment. It should be noted that the present invention should not be limited to the configuration of the above-described exemplary embodiment, but can be modified in various ways without departing from the scope of the invention.

Figure 10:
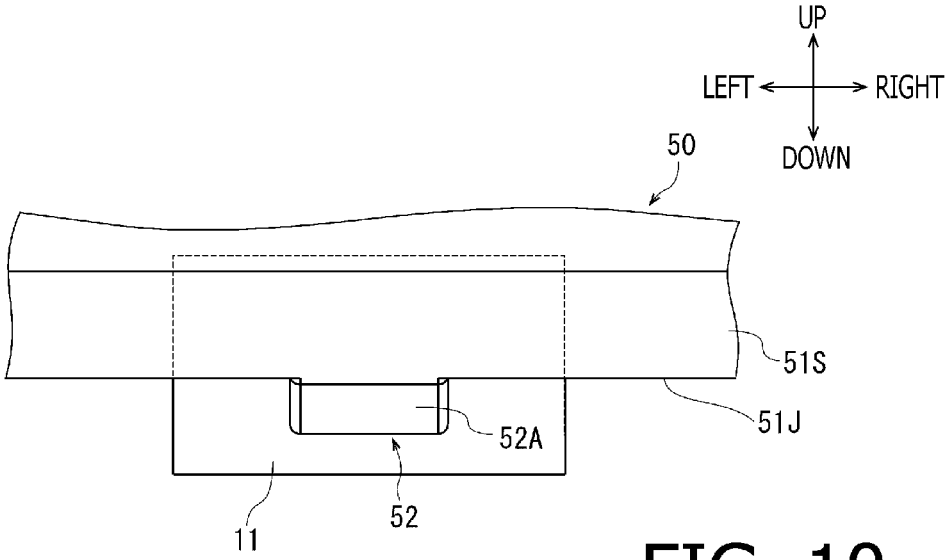
FIG. 10 is also a partial front view of an image forming device according to a second embodiment of the invention viewed along arrow Z.

For example, in the embodiment, the right and left guide portions 52 are formed to overlap the right and left end portions of the sheet supply roller 11 when viewed from the sheet feed direction. However, the invention needs not be limited to such a configuration. For example, as shown in FIG. 10, which shows a modification of the above-described embodiment, a single guide part 52 is formed to overlap a central portion of the sheet supply roller 11 when viewed from the sheet feed direction.

The sheet placing unit can be formed to be rockable between the spaced position and the close position, or can be configured to translate between those positions. Further, the sheet placing unit may be configured to be moved between the close position and the spaced position with being kept to incline downwardly. Further, a direction in which the pressure plate is displaceable needs not be limited to a vertical (i.e., the up-and-down) direction, but can be inclined with respect to the up-and-down direction. Further, the sheet placing unit may be configured to unmovable and arranged at a fixed position.

What is claimed is:

1. An image-forming apparatus, comprising:

a main body having a sheet-feed path and an opening, the sheet-feed path configured such that a sheet is fed along the sheet-feed path;

a sheet-placing part disposed in the main body and in communication with the opening;

a supply roller arranged to face the sheet-placing part and configured to feed the sheet from the sheet-placing part in a sheet-feed direction toward the sheet-feed path;

an image-forming unit provided in the main body and configured to form an image on the sheet; and a frame arranged to face the sheet-placing part and configured to support the supply roller, the frame comprising:

a protruding part that protrudes from a position upstream of the supply roller in the sheet-feed direction of the frame toward an upstream in the sheet-feed direction, the protruding part comprising an inclined surface facing the sheet-placing part and inclined such that a distance between the inclined surface and the sheet-placing part becomes gradually smaller toward a downstream in the sheet-feed direction; and a guide part arranged between the inclined surface and the supply roller, the guide part protruding toward the sheet-placing part, the guide part inclined such that a distance between the guide part and the sheet-placing part becomes gradually smaller toward a downstream in the sheet-feed direction.

2. The image-forming apparatus according to claim 1, wherein the guide part is arranged to overlap the supply roller when viewed from the sheet-feed direction.

3. The image-forming apparatus according to claim 1, wherein the frame is connected to the main body at both ends thereof, in a width direction of the sheet placed on the sheet-placing part, wherein the image-forming apparatus comprises:

a drive roller arranged between the supply roller and the image-forming unit, the drive roller configured to feed the sheet that has been fed to the sheet-feed path toward the image-forming unit;

a pinch roller supported by the frame and arranged to face the drive roller at an opening side of the sheet-feed path in the sheet-feed direction, with the sheet-feed path located therebetween, and configured to be driven by rotation of the drive roller to rotate; and an elastic member supported by the frame and configured to urge the pinch roller toward the drive roller.

4. The image-forming apparatus according to claim 3, wherein:

the frame is made of resin, the image-forming apparatus comprises a plurality of the pinch rollers arranged at one end portion and another end portion, in the width direction, with respect to the supply roller, and the protruding part is configured such that the protruding part is formed to be continuous, in the width direction, from a position on one end side with respect to the pinch roller to a position on another end side with respect to the pinch roller.

5. The image-forming apparatus according to claim 4, wherein the protruding part is formed with a rib for reinforcement.

6. The image-forming apparatus according to claim 5, wherein the rib extends, in the width direction, from one side to another side, and is curved or bent to surround the supply roller from the opening side in the sheet-feed direction.

7. The image-forming apparatus according to claim 1, wherein:

the sheet-placing part is displaceable between a spaced position, at which the sheet-placing part is spaced downward from the supply roller and a closed position, at which the sheet-placing part is displaced upward and close to the supply roller; and the supply roller contacts the sheet placed on the sheet-placing part when the sheet-placing part is displaced upward from the spaced position to the closed position, and feeds the sheet contacting the supply roller toward the sheet-feed path.

8. The image-forming apparatus according to claim 1, wherein an inclination of the inclined surface with respect to the sheet-placing part is smaller than an inclination of the guide part with respect to the sheet-placing part.

9. An image-forming apparatus comprising:

a main body having a sheet-feed path and an opening, the sheet-feed path configured such that a sheet is fed along the sheet-feed path;

a sheet-placing part disposed in the main body and in communication with the opening;

a supply roller arranged to face the sheet-placing part and configured to feed the sheet from the sheet-placing part in a sheet-feed direction toward the sheet-feed path;

a separation roller arranged on a downstream side, in the sheet-feed direction, of the supply roller and configured to separate the sheets fed to the sheet-feed path so that the sheets are fed one by one;

a roller holder configured to support the supply roller and the separation roller, wherein the roller holder supports the separation roller by surrounding the separation roller from both sides in an axial direction of the separation roller, and wherein the roller holder extends toward an upstream side of the separation roller in the sheet-feed direction; and a frame arranged to face the sheet-placing part, the frame comprising:

a receiving portion configured to receive the roller holder; and a protruding part protruding from the frame at a position upstream of the receiving portion in the sheet-feed direction, the protruding part protruding toward an upstream in the sheet-feed direction, the protruding part comprising an inclined surface facing the sheet-placing part and inclined such that a distance between the inclined surface and the sheet-placing part becomes gradually smaller toward a downstream of the sheet-feed direction; and a guide part is arranged between the inclined surface and the receiving portion, the guide part protruding toward the sheet placing part, the guide part inclined such that a distance between the guide part and the sheet-placing part becomes gradually smaller toward a downstream in the sheet-feed direction.

10. The image-forming apparatus according to claim 9, wherein the guide part protrudes toward a supply-roller side with respect to an end of the receiving portion in the sheet-feed direction.

11. The image-forming apparatus according to claim 9, wherein an inclination of the inclined surface with respect to the sheet-placing part is smaller than an inclination of the guide part with respect to the sheet-placing part.

12. The image-forming apparatus according to claim 9, wherein the roller holder further supports a first gear configured to drive the supply roller and a second gear configured to drive the separation roller, the second gear configured to drive the first gear.

* * * * *